United States Patent [19]

Michetti et al.

[11] 4,246,557

[45] Jan. 20, 1981

[54] BELL ALARM FOR CIRCUIT BREAKER

[75] Inventors: Anthony Michetti, Warminster; Charles Warner, Philadelphia, both of Pa.; John Rowan, Maple Shade, N.J.

[73] Assignee: Gould Inc., Rolling Meadows, Ill.

[21] Appl. No.: 52,288

[22] Filed: Jun. 26, 1979

[51] Int. Cl.[3] ..... H01H 73/12

[52] U.S. Cl. ..... 335/17; 335/8; 335/13

[58] Field of Search ..... 335/17, 13, 8–10, 335/156

[56] References Cited

U.S. PATENT DOCUMENTS

| | | | |
|---|---|---|---|
| 3,820,046 | 6/1974 | Layton et al. | 335/13 |
| 3,973,230 | 8/1976 | Ciarcia et al. | 335/17 |
| 4,019,005 | 4/1977 | Michetti | 200/144 R |
| 4,166,989 | 9/1979 | Castonguay et al. | 335/17 |

*Primary Examiner*—Harold Broome
*Attorney, Agent, or Firm*—Harold Huberfeld

[57] ABSTRACT

A multipole circuit breaker having a single contact operating mechanism for all poles and a fault current sensing means for automatic tripping of the breaker is provided with alarm switch means to indicate when opening of the circuit breaker has been caused by a fault condition. The operating mechanism includes a metal frame to which a latchable cradle is pivotally mounted. The frame includes parallel guide slots through which a formed pin actuator extends to be moved by the cradle as it operates between its latched and released (tripped) positions. A spring connected between the mechanism frame and the pin actuator biases the latter toward the cradle. An insulating extension element is adjustably mounted on the actuator to transmit motion of the latter to operate a switch in an alarm circuit, in accordance with cradle position.

11 Claims, 7 Drawing Figures

BELL ALARM FOR CIRCUIT BREAKER

This invention relates to multipole molded case circuit breakers in general and more particularly relates to an alarm switch for this type of circuit breaker.

U.S. Pat. No. 4,019,005 issued Apr. 19, 1977 to A. B. Michetti for a Multi-Pole Circuit Breaker With Baffled Shield Venting and other patents referred to therein, describe typical constructions for multipole molded case circuit breakers of relatively compact construction. In this type of circuit breaker a single overcenter spring toggle type contact operating mechanism is utilized for opening and closing the contacts of all pole units simultaneously. Very often an alarm switch is included to indicate when circuit breaker opening has occurred because of a fault current condition. More particularly, the operating mechanism includes a latchable cradle which is released automatically by a fault current sensing means when a fault current condition occurs. In turn, the released cradle operates a switch to actuate an alarm circuit which provides a positive indication that circuit breaker opening has occurred because of some condition other than normal operation of the contact operating mechanism.

Typically, an alarm switch of the type described above was part of an assembly which included a steel bracket that was insulated and was screwed to the base molding portion of the circuit breaker housing. The assembly also included a switch which was actuated by the cradle of the contact operating mechanism acting through a flat spring riveted to an insulated board, with the latter two elements being part of the assembly. All in all, the alarm switch assembly was relatively costly and expensive to assemble to the breaker.

In order to overcome these difficulties of the prior art the instant invention provides an alarm switch means in which the elements which are moved directly by releasable cradle of the contact operating mechanism are mounted in guide formations of the mechanism frame. The switch per se is mechanically mounted in the base by merely sliding the latter into slots in place of an interpole insulating barrier which partially closes off an aperture through which a contact tie bar extends. The housing cover retains the switch in its operative position.

Accordingly, a primary object of the instant invention is to provide a novel relatively inexpensive construction for a circuit breaker alarm switch.

Another object is to provide an alarm switch of this type having means to facilitate adjustment.

Still another object is to provide an alarm switch of this type in which key elements thereof are movably mounted to the frame of the circuit breaker contact operating mechanism.

A further object is to provide an alarm switch of this type wherein the switch section is mechanically mounted by merely dropping same into the base portion of the circuit breaker housing and utilizing the housing cover to retain the switch portion in its operative position.

These objects as well as other objects of the instant invention shall become readily apparent after reading the following description of the accompanying drawings in which.

Figure 1:
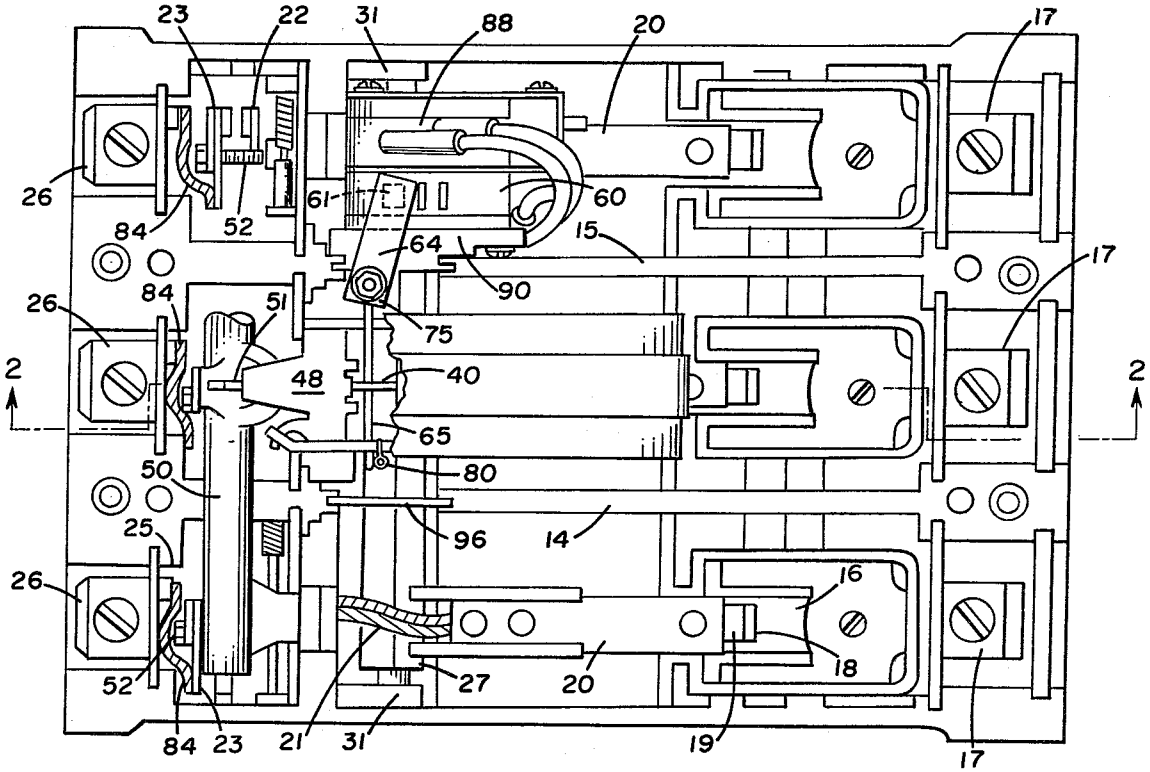
FIG. 1 is a plan view of a multipole molded case circuit breaker having the alarm switch of the instant invention mounted therein. For clarity, the cover of the circuit breaker and a major portion of the contact operating mechanism are not shown.
Figure 2:
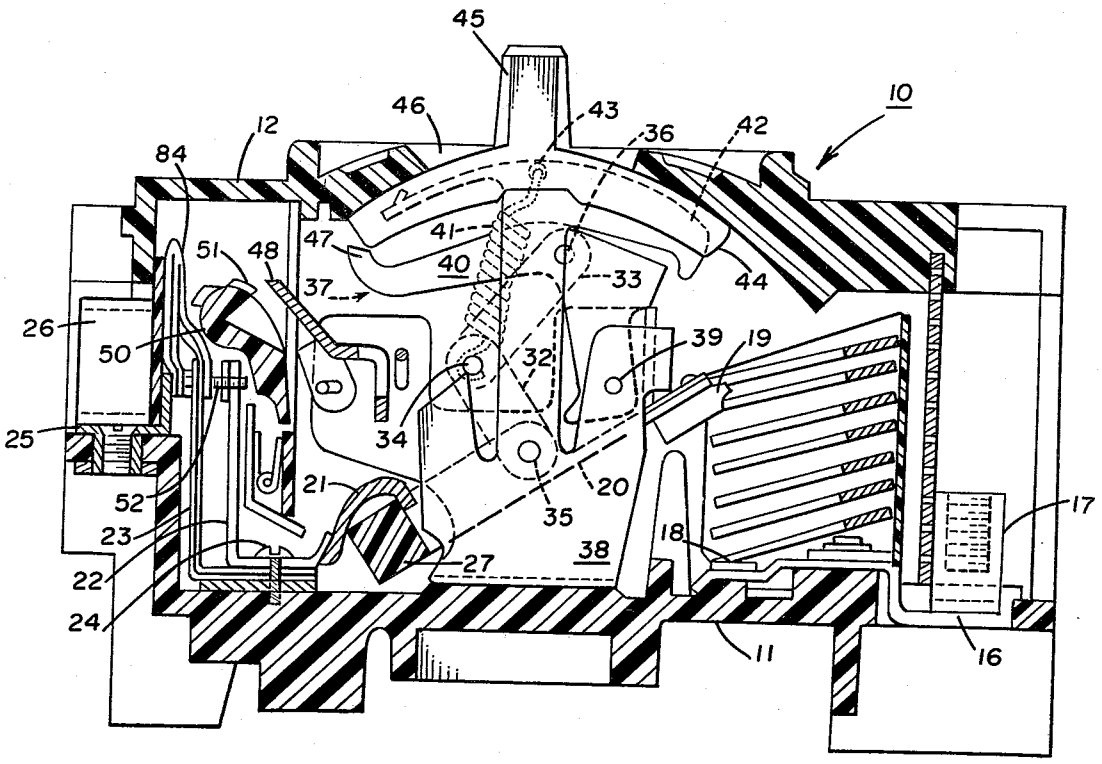
FIG. 2 is a cross-section taken through line 2—2 of FIG. 1 looking in the direction of arrows 2—2.

Now referring to the Figures. Three pole circuit breaker 10 of FIG. 2 includes a molded insulated housing consisting of hollow base 11 having an open front which is normally closed by cover 12. Parallel longitudinal partitions or barriers 14, 15 divide the interior of base 11 into three compartments each of which contains the current carrying elements for a pole of circuit breaker 10. The current path through each of the poles consists of line terminal 16 having wire grip 17 at one end and stationary contact 18 at the other end. The latter is engageable by movable contact 19 at one end of movable contact arm 20. The other end of the arm 20 is connected by flexible conductor 21 to protective shunt 22 for bimetal 23. Screw 24 secures shunt 22 and bimetal 23 to base 11, and flexible conducter 84 is connected from bimetal 23, at its end remote from flexible conductor 21, to load terminal 25 having wire grip 26 mounted thereon.

For all three poles, the ends of contact arms 20 remote from movable contacts 19 are rigidly connected to transverse tie bar 27 which extends through aligned cutouts 28, 29 in the respective barriers 14, 15. The rounded ends of tie bar 27 are pivotally mounted in bearing formations of brackets 31 secured to base 11. Toggle links 32, 33 of common operating mechanism 37 are connected by knee pin 34 and extend between pin 35 through contact arm 20 of the center pole and pin 36 which extends through generally V-shaped cradle 40 near the apex thereof. Cradle 40 is pivotally mounted by pin 39 to mechanism frame 38. Main operating spring 41 is a coiled tension member extending between toggle knee 34 and operating member 42 at aperture 43 thereof. Member 42 is pivotally mounted at its rear end to frame 38 at locations generally aligned with the position of rear toggle pivot 35 when circuit breaker 10 is open. The forward end of operating member 42 is provided with insulating cap 44 having projection 45 which extends forward of cover 12 through elongated aperture 46 thereof to constitute a manually engageable operating handle.

Figure 7:
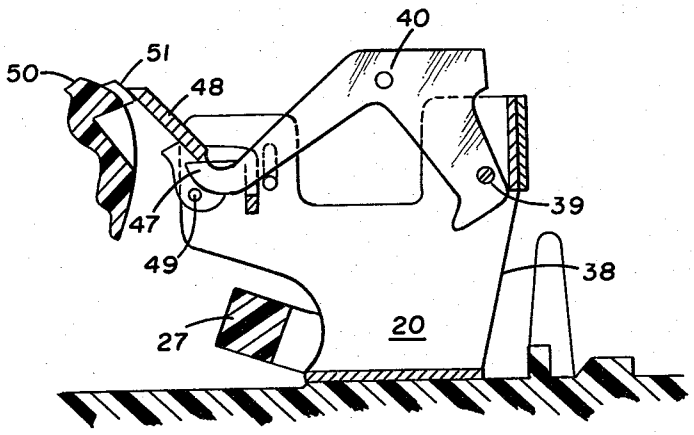
FIG. 7 is a fragmentary side elevation showing the cradle in its reset position and the contact arm in closed position.

To reset contact operating mechanism 37, cradle 40 is pivoted to its reset position shown in FIG. 7 wherein latching tip 47 at the end of cradle remote from pivot 39 is engaged by intermediate latch member 48 mounted to frame 38 at pivot 49. In the latched position of FIG. 7 intermediate latch 48 engages main latch 51 carried by trip bar 50. In a manner well known to the art, trip bar 50 is a transverse pivotally mounted member which is operable counterclockwise with respect to FIGS. 2 and 7 by deflection of bimetal 23 acting through adjusting screw 52. Such counterclockwise rotation of trip bar 50 frees auxiliary latch member 48 from main latch 51 so that the biasing force exerted by spring 41 is free to move cradle 40 clockwise about its pivot 39 to the tripped position shown in FIG. 2. In order to ascertain that cradle 40 is in its tripped position of FIG. 2, circuit breaker 10 is provided with alarm switch 60 having normally closed contacts 99 (FIG. 6) which are opened when switch operator 61 is depressed. The latter operation occurs when cradle 40 is in its latched position of FIG. 7, at which time it acts through actuator 65 and its insulating extension 64 to move operator 61 rearward.

Figure 4:
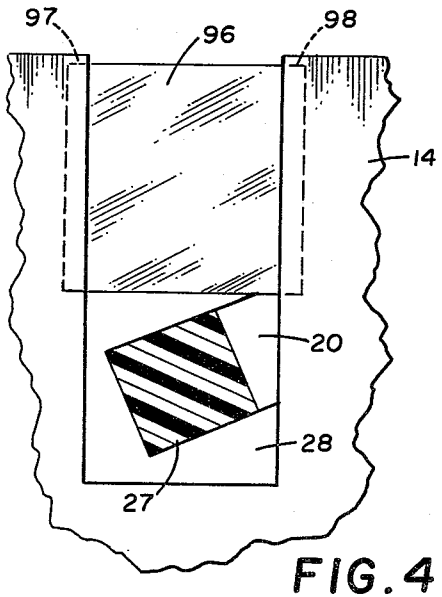
FIG. 4 is a fragmentary side elevation looking in the direction of arrows 4—4 of FIG. 3 showing a base partition in the region of the tie bar for the movable contact arms.
Figure 3:
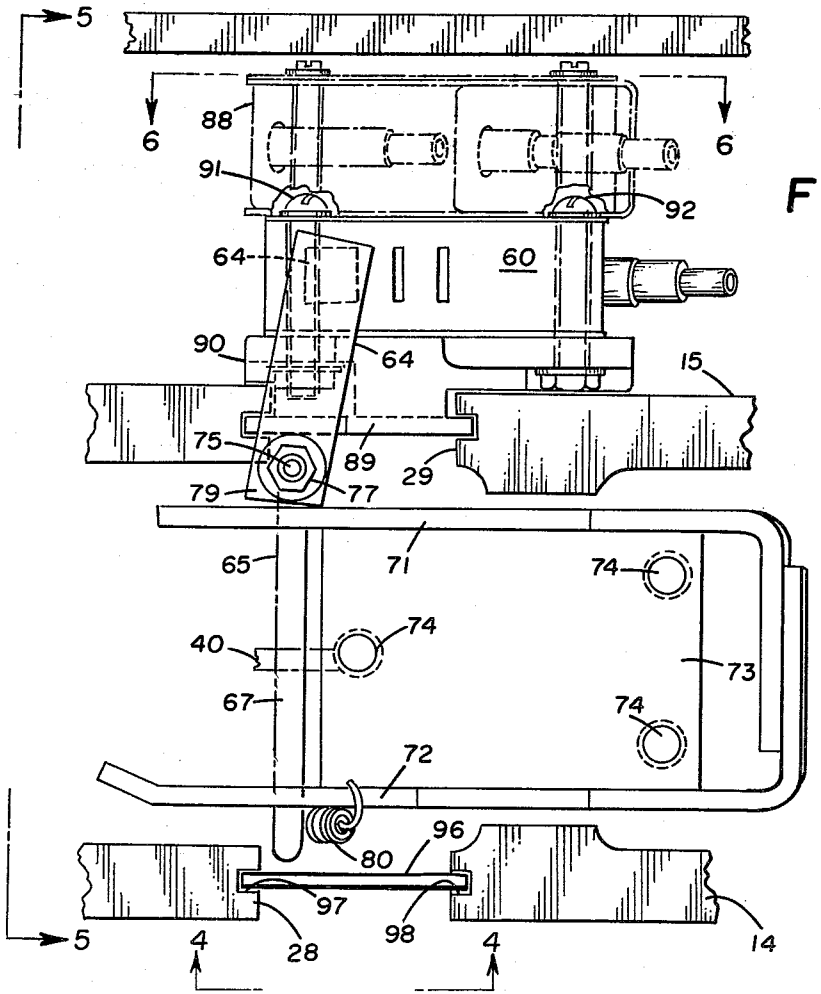
FIG. 3 is an enlarged plan view showing the alarm switch mounted to the frame of the circuit breaker contact operating mechanism.
Figure 5:
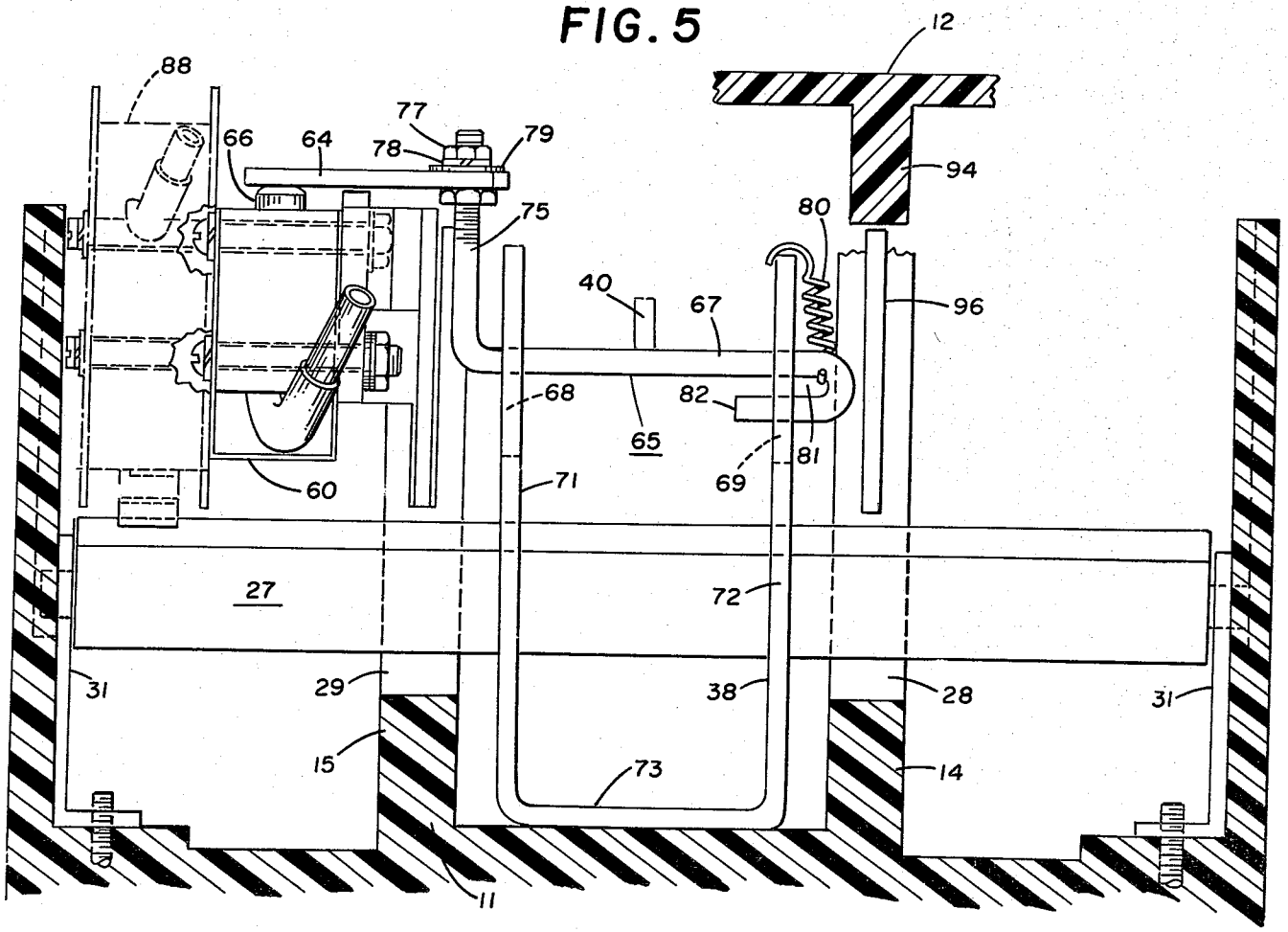
FIG. 5 is an elevation looking in the direction of arrows 5—5 of FIG. 3.

More particularly, actuator 65 is a formed pin including main transverse section 67 which extends through aligned guide apertures 68, 69 in the respective arms 71, 72 of U-shaped frame 38. Arms 71, 72 are connected by rear web 73 which is provided with a plurality of tapped apertures to receive fastening means securing operating mechanism 37 to base 11. Forward extension 75 at one end of main section 67 isthreaded at its free end to mount nuts 76, 77, lock washer 78 and flat washer 79. Extension 64 is a flat elongated insulator whose end remote from switch operator 61 is clamped between nut 76 and flat washer 79. The extended length of the threads at the free end of forward extension 75 facilitate adjustment of extension member 64 relative to operator 61. The end of actuator 65 remote from forward extension 75 is reversely bent to extend through guide slot 67 and cooperate therewith to prevent pivoting of main section 67 about its longitudinal axis. Coiled tension spring 80 engages the forward edge of frame arm 72 and engages actuator 65 by extending through space 81 disposed outboard of frame arm 72 and formed between main section 67 and reversely bent section 82. Spring 80 constantly provides a biasing force urging actuator 65 forward, so that when cradle 40 is in its tripped position of FIG. 2, main section 67 moves to the forward ends of guide slots 68, 69 and switch operator 61 is permitted to move forward so that the cooperating contacts of auxiliary switch 60 close. As seen best in FIGS. 3–5, the opposed walls bounding cutout 28 in barrier 14 are, at their forward ends, provided with aligned slots 97, 98 which slidably receive edge portions of removable insulating barrier sheet 96. Rearwardly extending longitudinal barrier strip 94 of cover 12 is aligned with base rib 14 so as to capture barrier element 96 in slots 97, 98.

Screws 91, 92 secure alarm switch 60 to insulating block 90. The latter includes thin face portion 89 having opposite edge portions which are slidably received in the slots of base barrier 15 which are proportioned and disposed to receive another removable barrier element 96. A portion of a cover barrier (not shown) parallel to barrier 94 is aligned with base barrier 15 and is positioned so that a portion thereof is close to block 90 to prevent the latter from accidentally becoming dislodged from barrier 15. The cover barrier aligned with base barrier 15 is notched to provide clearance for actuator extension 64.

Figure 6:
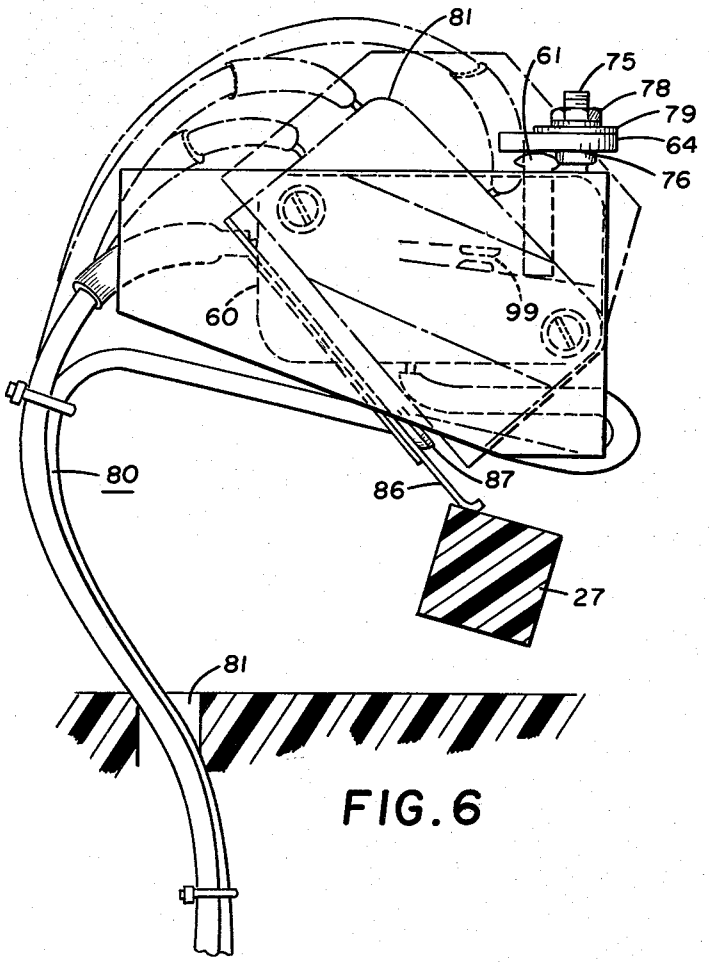
FIG. 6 is a side elevation of the alarm switch assembly looking in the direction of arrows 6—6 of FIG. 3.

Mounted to the side of switch 60 remote from mounting block 90 is auxiliary switch 88 which, as seen in FIG. 6, is provided with depressible contact operator 87 and leaf spring 86. The latter is engaged by contact tie bar 27 when contacts 18, 19 are engaged. This engagement between tie bar 27 and spring 86 depresses operator 87 to operate the contacts (not shown) of auxiliary switch 88 from their normal positions. In a manner well known to the art, the flexible insulation covered wire leads 80 connected to the contacts of switches 60, 88 extend outside of housing 11, 12 through aperture 81 in the rear of base 11.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A multipole circuit breaker including a hollow base having an open front; a removable cover secured to said base to cover said open front; said base having integrally formed barrier means dividing the interior of said base into a plurality of longitudinally extending compartments; within each of said compartments, a stationary contact and a cooperating movable contact engageable with said stationary contact; a transverse tie bar having said movable contacts of all poles operatively connected thereto for simultaneous operation of all said movable contacts; a spring powered contact operating mechanism operatively connected to said tie bar for simultaneously operating the movable contacts of all the circuit breaker poles into and out of engagement with their cooperating stationary contacts; said operating mechanism disposed within a first of said compartments and including a frame secured to said base and a releasable cradle mounted on said frame; latch means which when latched engages said cradle to hold the latter in a reset position permitting said operating mechanism to move said movable contacts into engagement with their cooperating respective stationary contacts, fault current responsive trip means operable to trip said latch means to release said cradle thereby controlling said operating mechanism to prevent said cooperating contacts from engaging; a switch unit in a second of said compartments next to said first compartment; said switch unit including a housing, a contact operator extending therefrom and contact means within said housing operable by said operator; an actuator mounted on said frame and guided for limited forward and rearward movement; biasing means urging said actuator forward; said cradle in moving toward its said reset position engaging said actuator and moving the latter rearward to operate said contact operator to move said contact means of said switch unit from its normal position.

2. A multipole circuit breaker as set forth in claim 1 in which the frame includes first and second spaced forwardly extending arms having aligned guide slots; said actuator including a formed rod having a main central section extending between said arms and through said slots to cooperate therewith in guiding frontward and rearward motion of said actuator; said rod having a forward projection at one end thereof; an insulating transverse extension between said contact operator and said projection, being connected to the latter at its forward end.

3. A multipole circuit breaker as set forth in claim 2 in which the biasing means comprises a tension spring connected between said frame and said rod at the other end thereof.

4. A multipole circuit breaker as set forth in claim 3 in which the tension spring retains the rod in operative position on said frame.

5. A multipole circuit breaker as set forth in claim 2 in which there is adjustable connecting means securing the insulating extension to said projection.

6. A multipole circuit breaker as set forth in claim 4 in which the biasing means comprises a tension spring connected between said frame and said rod at the other end thereof.

7. A multipole circuit breaker as set forth in claim 5 in which the other end of said arm also includes a reversely bent section which extends through one of said slots and cooperates therewith to prevent pivoting of said central section about its longitudinal axis.

8. A multipole circuit breaker as set forth in claim 2 in which the other end of said arm also includes a reversely bent section which extends through one of said slots and cooperates therewith to prevent pivoting of said central section about its longitudinal axis.

9. A multipole circuit breaker as set forth in claim 1 in which the barrier means includes a first cutout through which the tie bar extends; said switch unit being secured to said barrier means by interlocking formations in said switch unit and said barrier means in the region of said cutout; said switch unit closing a portion of said cutout forward of said tie bar.

10. A multipole circuit breaker as set forth in claim 9 in which the cover includes a portion positioned to maintain said interlocking means operatively engaged.

11. A multipole circuit breaker as set forth in claim 10 in which the interlocking formations includes spaced parallel slots extending generally in a front to rear direction.

* * * * *